US005842777A

United States Patent [19]

McDermott

[11] Patent Number: 5,842,777

[45] Date of Patent: Dec. 1, 1998

[54] FLASHLIGHT

[76] Inventor: Kevin McDermott, 196 Phillips Dr., Hampstead, Md. 21074

[21] Appl. No.: 511,280

[22] Filed: Aug. 4, 1995

[51] Int. Cl.[6] ..... F21L 7/00

[52] U.S. Cl. ..... 362/205; 362/157; 362/158; 362/202; 362/206

[58] Field of Search ..... 362/157, 158, 362/202, 205, 206

[56] References Cited

U.S. PATENT DOCUMENTS

| | | | |
|---|---|---|---|
| 3,124,306 | 3/1964 | Schotz | 362/158 |
| 3,252,733 | 5/1966 | Moore et al. | 362/157 |
| 3,758,773 | 9/1973 | Nau | 362/158 |
| 5,161,879 | 11/1992 | McDermott | 362/206 |
| 5,260,858 | 11/1993 | Maglica | 362/158 |

*Primary Examiner*—Sandra O'Shea
*Assistant Examiner*—Matthew J. Spark

[57] ABSTRACT

The present invention describes a flashlight powered with an oblong power supply. The flashlight is designed to be compact and watertight. It is protected against the entrance of moisture with a single O-ring seal. The case of the flashlight can be injection molded and can be used without secondary fabrication such as gluing. The flashlight includes a light module which is held to prevent its rotation relative to the case to thereby maintain a desired polarity with the power supply permitting a variety of polarity responsive lamps or circuits to be incorporated into the design. Some configurations create light output color or intensity changes by reversing the batteries. On-Off switching is accomplished using a mechanism independent of the location of the power supply so that power supply movement will not cause inadvertent energizing of the lamp or hazardous sparks.

30 Claims, 4 Drawing Sheets

FLASHLIGHT

BACKGROUND OF INVENTION

Prior Art designs that incorporate oblong batteries can be found in U.S. Pat. No. 3,124,306 issued to Schotz. In this design, batteries 46 and 46A form an oblong contour when viewed from the front of the case. Bulb and reflector assembly 74 is positioned along the longitudinal axis of battery 46. Battery 46A is electrically contacted by leg 144 of ring 130. In this design, the batteries are not easily installed because ring 130 must be moved to permit removal of battery 46A. Since bulb and reflector assembly 74 is placed along the axis of battery 46 it is not centered on the case making the size of the flashlight unnecessarily large. Cylindrical section 58 includes continuous threads 66 to permit ring 18 to be attached. Even if handle 24 were removed and bulb reflector assembly 74 reduced in size this design does not create a compact flashlight because as seen in FIG. 7, the outside diameter of ring 18 must include the largest linear dimension of the oblong two battery contour plus twice the thickness of enclosing wall 32 plus twice the height of thread 66 plus twice the thickness of the wall of ring 18.

SUMMARY OF THE INVENTION

The present invention describes a flashlight which is very compact in design. The bulb/reflector assembly or light module is centered about the centroidal axis of an oblong battery pack or power supply to create a compact and symmetrical assembly. The light module is retained by a bezel which is itself retained in the case by partial thread section molded into the flashlight case. The case is configured and the location of the partial thread section on the case is chosen so that the thread section does not increase the outside diameter of the flashlight and does not interfere with easy access to the oblong power supply. The case design permits it to be injection molded and used without subsequent fabrication or sealing. The power supply includes an oblong contour within which both its positive and negative terminals are located. The case accepts the power supply through an opening in its head section and holds it in its battery cavity such that its oblong contour is visible through the head opening. The overall design assures that the light module upon being assembled into the case has each of its electrical terminals contacting the appropriate related terminal of the power supply. This permits a polarity sensitive lamp or circuit to be incorporated into the light module. It also permits the inclusion of a light module which emits an alternate light output upon a reversal of the batteries. In this configuration, the operator upon deciding to change to the alternate light output is instructed to deliberately install the power supply with its polarity reversed thereby energizing the light module with a reverse polarity to alter its light output. The components and dimensions of the flashlight are designed to maintain proper electrical contact between the power supply and light module even when the power supply is reversed. This is especially important when batteries with projections on one end are employed.

Energizing the light module is achieved by a switching mechanism which is not affected by a movement or shifting of the power supply. Some prior art designs energize the flashlight by rotating the bezel or lens so that the bulb reflector assembly is moved towards the battery to contact the battery terminals and complete the circuit. In these designs continued rotation of the bezel compresses a contact spring against the battery. This design can be a problem because at the instant the circuit is completed and the bulb is energized the contact spring has developed very little pressure against the battery. At this instant, quick movement of the flashlight can, due to the weight of the battery, cause the battery to shift and compress the contact spring to thereby temporarily alter the switch mode. This inadvertent switch operation frequently results in internal sparking at the battery terminal. Batteries can under certain circumstances create a hydrogen atmosphere and an inadvertent switch spark can create an explosion. In the present invention, movement of the batteries does not affect the switching. The batteries are held firmly in position with a contact spring that maintains substantial contact pressure throughout the normal movement of the bezel. Since movement of the batteries is firmly restricted by substantial constant spring pressure, the present invention avoids the safety hazard that would be created by shaking or dropping the flashlight. Also, since the location of the batteries does not affect switching, they can be reversed without concern that this reversal, due to projections on one end of the batteries, may change the switch function as a result of changes in the dimensional relationship or contact forces between the batteries and light module.

DETAILED DESCRIPTION OF THE DRAWINGS

Figure 1:
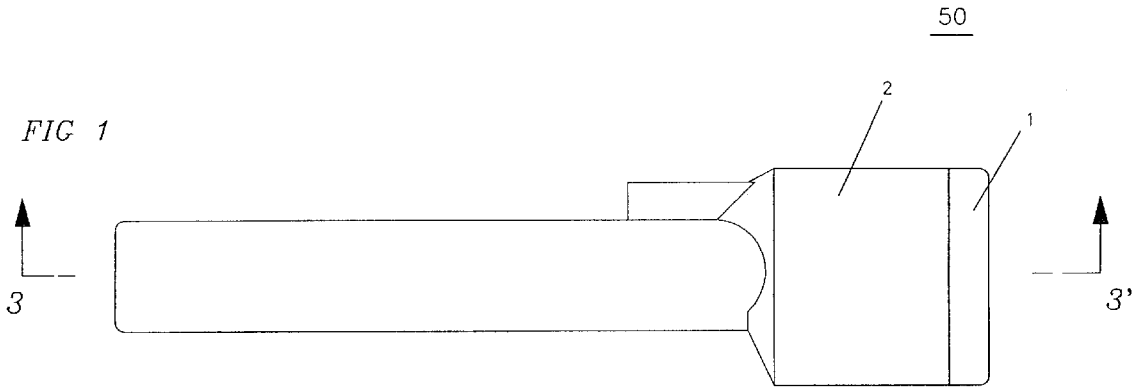
FIG. 1 is a top view of a flashlight 50.
Figure 2:
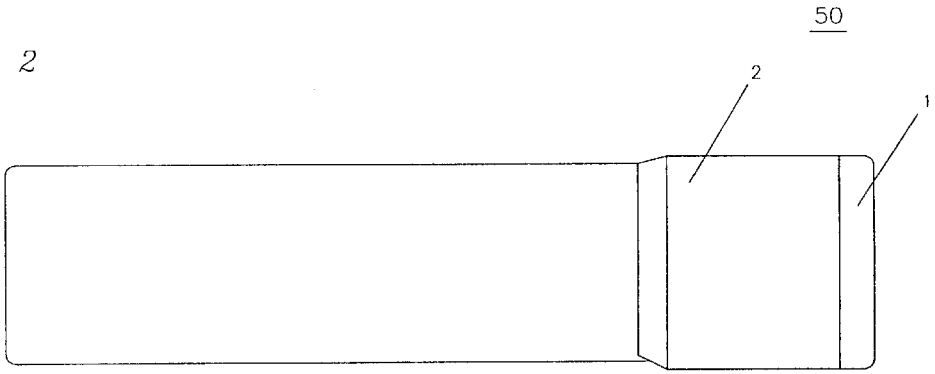
FIG. 2 is a front view of flashlight 50 from FIG. 1.

FIGS. 1 through 11 describe a preferred embodiment of the invention. FIGS. 1 and 2 are top and side views of flashlight 50 which includes bezel 1 and case 2.

Figure 3:
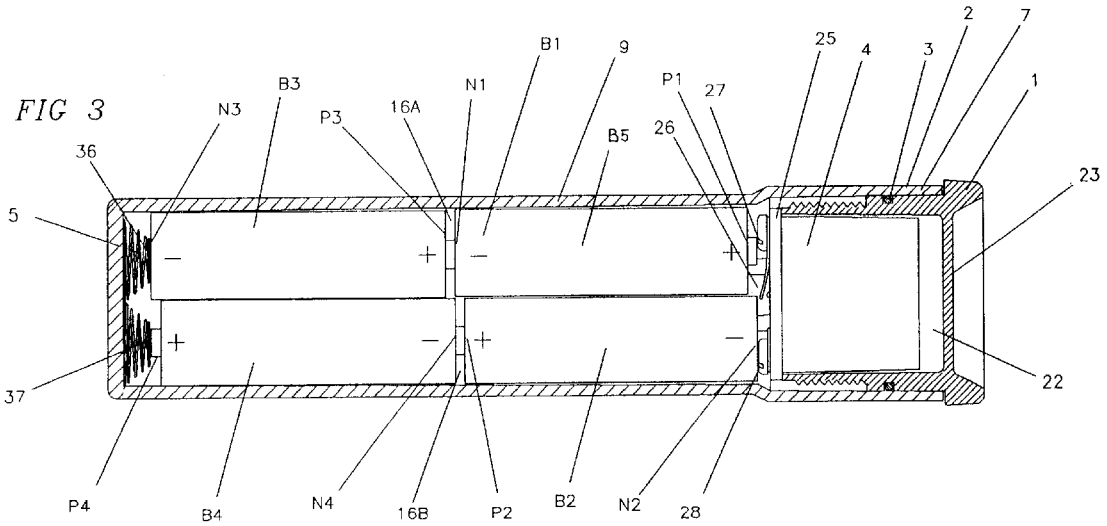
FIG. 3 is a cross-sectional view of flashlight 50 taken across line 3-3' of FIG. 1.

FIG. 3 is a cross-sectional view taken across line 3-3' of FIG. 1 with some interior components shown without sectioning. Interior components include: O-ring 3, light module 4, base spring 5 and batteries B1 through B4.

Figure 4:
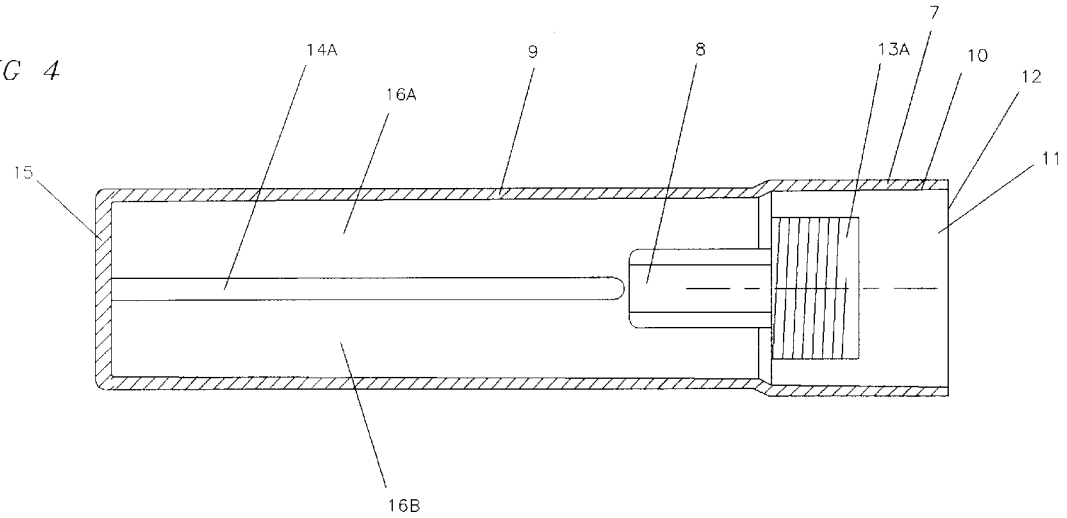
FIG. 4 is the cross-sectional view of case 2 removed from FIG. 3.

FIG. 4 is a cross-sectional view of case 2 removed from FIG. 3.

Figure 5:
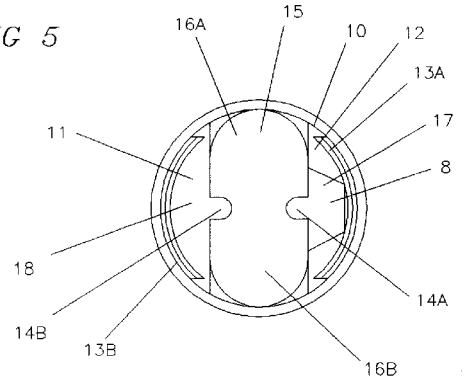
FIG. 5 is a right side view of case 2 from FIG. 1 with all other components removed.

FIG. 5 is a right side view of case 2 from FIG. 1 with all other components of flashlight 50 removed. Case 2 includes:

head section 7, offset section 8 and battery section 9 all of which are hollow. Case 2 can be injection molded of a high impact plastic as a single unitary component and employed to provide a watertight enclosure without the need for a secondary sealing operation. Head section 7 includes: interior wall 10, head cavity 11 head opening 12 and thread sections 13A and 13B which are portions of a single continuous internal thread. Battery section 9 is elongated and includes: battery ribs 14A and 14B, base 15 and battery cavities 16A and 16B. Offset section 8 includes: offset cavity 17. Switch wall 18 is at the intersection of head section 7 and battery section 9. Interior wall 10 defines a head opening 12. Switch wall 18 connects head section 7, offset section 8 and battery section 9 such that they form an integral case 2 which except for head opening 12 is watertight. Switch wall 18 is substantially perpendicular to elongated battery section 9.

Figure 6:
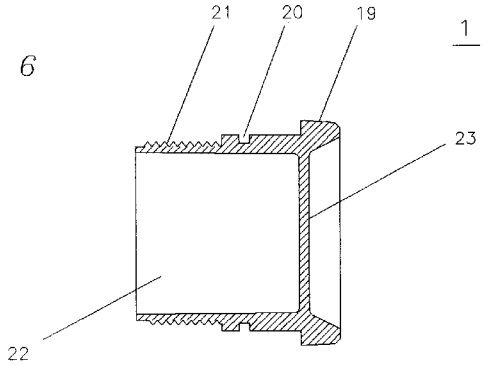
FIG. 6 is a cross-sectional view of bezel 1 removed from FIG. 3.

FIG. 6 is a cross-sectional view of bezel 1 removed from FIG. 3. Bezel 1 is molded of a transparent plastic and includes: grip ring 19, O-ring groove 20, thread 21, bezel cavity 22 and bezel cover or lens 23.

Figure 7:
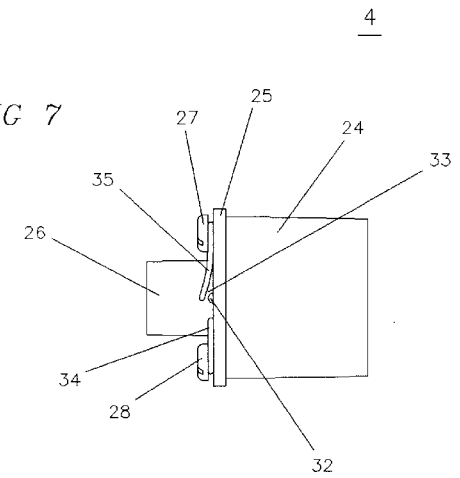
FIG. 7 is a view of light module 4 removed from FIG. 3.

FIG. 7 is a view of light module 4 removed from FIG. 3.

Figure 8:
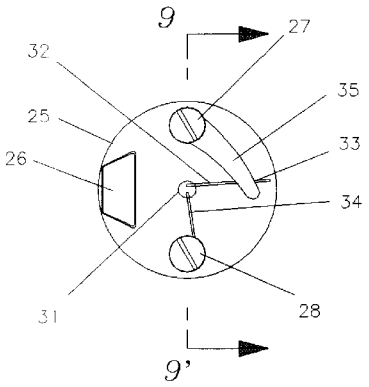
FIG. 8 is a left side view of light module 4 of FIG. 7.

FIG. 8 is a left side view of the FIG. 7 light module 4.

Figure 9:
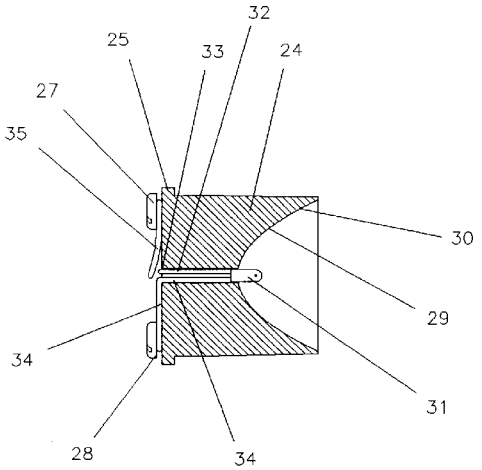
FIG. 9 is a cross-sectional view of light module 4 taken across line 9-9' of FIG. 8.

FIG. 9 is a cross sectional view of light module 4 taken across line 9-9' of FIG. 8. Light module 4 includes: body 24, flange 25, offset stud 26, positive terminal 27, negative terminal 28, parabolic contour 29 and reflector 30. Body 24 is constructed of plastic and is contoured to form a polished parabolic contour 29 which is subsequently metallized to form reflector 30. Lamp 31, shown not cross-sectioned, is a bicolor light emitting diode lamp which comprises positive lamp lead 32 bent towards switch contact point 33 and negative lamp lead 34 bent to fasten to negative light module terminal 28. Spring brass contact arm 35 is fastened to positive light module terminal 27 and is formed such that in its normal state it is separated from positive lamp lead 32 at switch contact point 33. Spring contact arm 35 can also be identified as a switch activation arm. As long as spring contact arm 35 is separated from positive lamp lead 32 at switch contact point 33 lamp 31 is not energized. Lamp 31 is polarized such that when energized with a positive battery potential at positive lamp lead 32 and a negative battery potential at negative lamp lead 34 it emits a red light. If the applied battery potentials are reversed lamp 31 emits a green light.

Figure 10:
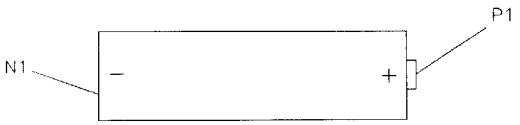
FIG. 10 is a view of battery B1 removed from FIG. 3.

FIG. 10 is a view of battery B1 removed from FIG. 3. Battery B1 is typically 1½ volts and includes a positive terminal P1 and negative terminal N1. Battery B1 is similar to batteries B1 through B4 and can be any of a variety of standard cells such as C, D, or AA.

Figure 11:
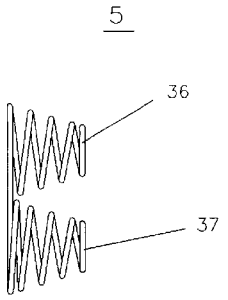
FIG. 11 is a view of base spring 5 removed from FIG. 3.

FIG. 11 is a view of base spring 5 removed from FIG. 3.

Base spring 5 is a single piece of electrically conductive wire formed into first and a second coils 36 and 37 respectively. Coils 36 and 37 are each tapered compression springs. Base spring 5 could also be supplied as a single coil or a flat spring.

Figure 12:
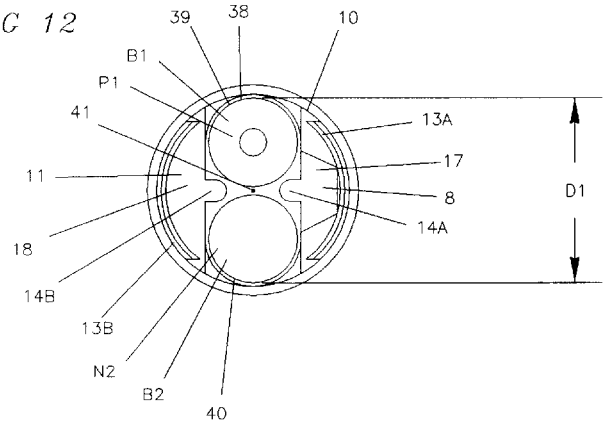
FIG. 12 is a right side view of case 2 of flashlight 50 from FIG. 1 with all components except the batteries removed.

FIG. 12 is a right side view of case 2 of flashlight 50 from FIG. 1 with all components except the batteries removed. Batteries B1 and B4 remain and define an elongated power supply contour 38 which can be seen through head opening 12.

Referring back to FIGS. 1 through 11 and especially FIG. 3 batteries B1 and B3 are installed in battery cavity 16A with their negative terminals N1 and N3 facing base spring 5. Coil 36 of spring 5 is designed to maintain pressure against battery B3 throughout the range of movement of bezel 1. Batteries B2 and B4 are installed in battery cavity 16B with their positive terminals P2 and P4 facing base spring 5. Coil 37 of spring 5 is similarly designed to maintain pressure against battery B4 throughout the range of movement of bezel 1. Battery ribs 14A and 14B in case 2 prevent batteries B1 and B3 from falling into battery cavity 16B before batteries B2 and B4 are installed. Base spring 5 constructed of a metallic wire provides an electrically conductive path between the negative terminal N3 of battery B3 and the positive terminal P4 of battery B4. As a result of this connection batteries B1 through B4 are in a series configuration and operate as a single 6 volt battery or power supply B5 with its positive terminal at the positive terminal P1 of battery B1 and its negative terminal at the negative terminal N2 of battery B2. It can be seen in FIG. 12 that the elongated power supply contour 38 is the sum of circular shapes 39 and 40 defined by the ends of batteries B1 and B2 respectively. The largest linear dimension of elongated power supply contour 38 is distance D1. The centroid of elongated power supply contour 38 is at point 41. Point 41 is also the end view of the centroidal axis of power supply B5. Point 41 is also the centroid of the circular interior wall 10. Point 41 is also the end view of the centroidal axis and the centroid of head cavity 11. The entire elongated power supply contour 38 is visible through head opening 12 of head section 7. O-ring 3 is installed in O-ring groove 20 of bezel 1 and light module 4 is installed in bezel cavity 22. Flange 25 of light module 4 prevents light module 4 from falling into bezel cavity 22. Using bezel grip ring 19 bezel 1 is inserted into head cavity 11 of head section 7 wherein O-ring 3 forms a watertight seal against circular interior wall 10. Offset element or offset stud 26 of light module 4 enters offset cavity 17 of case 2. This prevents light module 4 from rotating as bezel 1 is screwed into case 2. Thread sections 13A and 13B are separated and located to permit unobstructed viewing of elongated power supply contour 38 and easy access to batteries B1 and B2. During assembly of flashlight 50 bezel 1 including light module 4 is pushed into head cavity 11 and rotated such that bezel thread 21 engages thread sections 13A and 13B of case 2. Base spring 5 is deflected or compressed so that it creates forces which push batteries B1 through B4 toward light module 4. These base spring 5 forces assure that the batteries or power supply are in full contact with positive terminal 27 and negative terminal 28 of light module 4 throughout the range of movement of bezel 1. They also urge light module 4 and switch contact arm 35 to separate from switch contact wall 16. Positive terminal 27 of light module 4 is contacting positive terminal P1 of battery B1 and negative terminal 28 of light module is contacting negative terminal N2 of battery B2. Lamp 31 is not "ON" because switch contact arm 35 has not contacted switch wall 18 of case 2. As bezel 1 is further screwed into case 2, it develops forces which overcome base spring 5 forces and thereby moves switch contact arm 35 towards switch wall 18. Upon continued movement of bezel 1 switch contact arm 35 contacts switch wall 18 and is pushed by switch wall 18 into positive lamp lead 32 at switch contact point 33. This completes the electrical circuit and lamp 31 emits red light. The emitted light is redirected by reflector 30 and emerges from flashlight 50 through bezel lens 23. An intermediate component can be added to the switch design to contact switch wall 18 to thereby move switch contact arm 35 to effect switching at switch contact point 33. The location of the offset element or stud 26 in offset cavity 17 assures that the battery and light module 4 terminals are properly aligned regardless of the degree of entry of bezel 1 into case 2.

Referring to FIG. 12, it can be seen that the outside diameter of flashlight 50 includes the largest linear dimension D1 of the elongated battery contour 38 plus twice the thickness of interior wall 10. This makes the current invention exceedingly compact and also substantially symmetrical about centroid point 41 of elongated power supply contour 38. Head opening 12 is circular and defined by interior wall 10 when viewed from the right side of FIG. 4.

Figure 13:
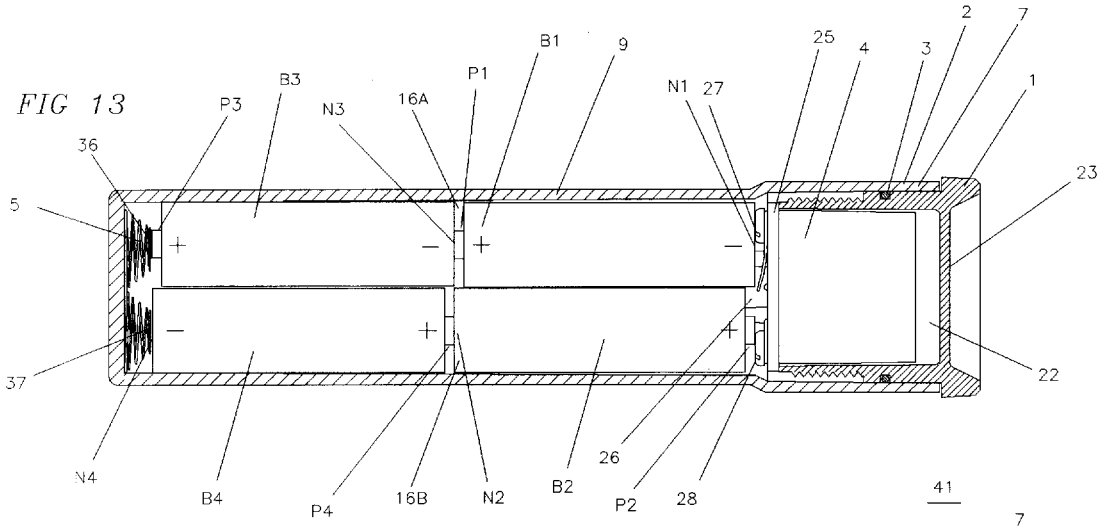
FIG. 13 is a cross-sectional view of flashlight 50 similar to FIG. 3 except that the batteries are installed with reversed polarity.

FIG. 13 is a cross-sectional view of flashlight 50 similar to that of FIG. 3 except batteries B1 through B4 are now installed in case 2 with their polarities reversed. With batteries B1 through B4 reversed, positive light module terminal 27 contacts negative terminal N1 of battery B1 and negative light module terminal 28 contacts positive terminal P2 battery B2. In this reversed battery configuration, the 6 volt power supply B5 potential applied to lamp 31 has been reversed and lamp 31 will emit green light. Due to the characteristics of bicolor lamp 31 the intensity of the green light is usually less than the intensity of the red light. Using this concept of polarity reversal a designer can incorporate into light module 4 a polarity sensitive circuit which can alter the intensity of any lamp employed n light module 4 in response to a reversal of the batteries.

Figure 14:
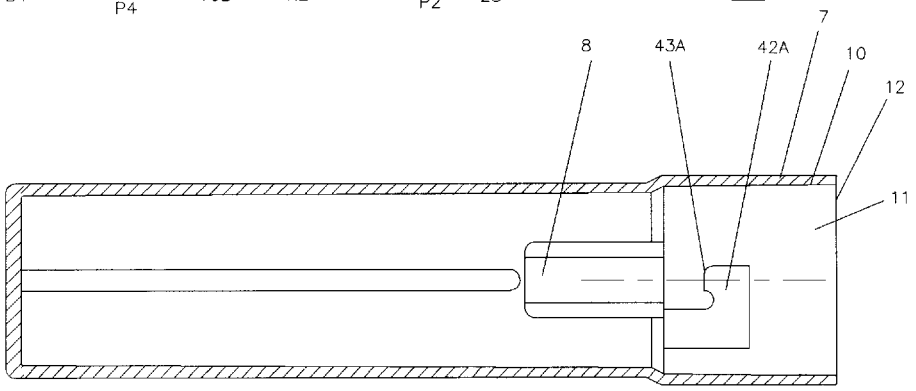
FIG. 14 is a cross-sectional view of case 39 which can substitute for case 2 of FIG. 3.

FIG. 14 is a cross-sectional view of alternate case 41 which can substitute for case 2 of FIG. 3. Case 41 is identical to case 2 except it substitutes head locking element 42A in lieu of thread section 13A. A similar head locking element would be substituted for thread section 13B. Head locking element 42A is a wall which is inwardly extending from interior wall 10 of hollow head section 7. It forms overhanging ledge 43A.

Figure 15:
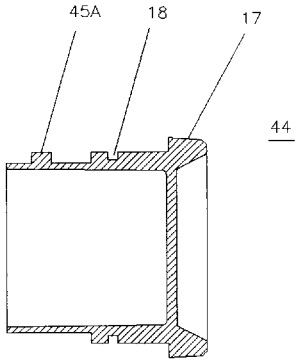
FIG. 15 is a cross-sectional view of bezel 42 which can substitute for bezel 1 of FIG. 3.

FIG. 15 is a cross-sectional view of alternate bezel 44 which can substitute for bezel 1 of FIG. 3. Bezel 44 is identical to bezel 1 except bezel locking element 45A is substituted for bezel thread 19. Bezel locking element 45A is a round pin projecting from the outside diameter of bezel 44. Case 41 and bezel 44 are employed together to replace case 2 and bezel 1 of FIG. 3. During use, bezel 44 is inserted into and rotated about hollow head section 7 of case 41 so that bezel locking element 45A fits under overhanging ledge 43A. Case 41 and bezel 44 mate and lock in the same fashion as a standard bayonet base bulb mates and locks into its socket. Base spring 5 provides the pressure to retain bezel locking element 45A under overhanging ledge 43A. The design would also function if overhanging ledge 43A were on bezel 44 and round pin bezel locking element 45A were on holder head section 7.

Figure 16:
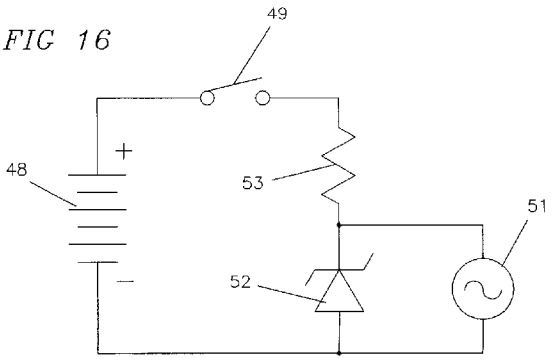
FIG. 16 is an electrical schematic of an alternate circuit.

FIG. 16 is an electrical schematic of an alternate electrical circuit which can be employed in flashlight 50 to reduce its intensity upon battery reversal. In FIG. 16 battery 48 represents the 6 volt power supply as previously described. This includes batteries B1 through B4 in a series arrangement. Switch 49 represents the switch at switch contact point 33 as previously described. Lamp 51 is typically a 5 volt incandescent lamp. Zener diode 52 forms a parallel arrangement with incandescent lamp 51. Resistor 53 is in series with that parallel arrangement. Incandescent lamp 51, zener diode 52 and resistor 53 as shown in FIG. 16 have been substituted for previously described bicolor lamp 31. Zener diode 52 limits the voltage across lamp 51 to 4 volts underpowering lamp 51 such that it emits a dim light. If, however, the polarity of power supply 48 is reversed then zener diode 52 does not conduct and does not limit the voltage across lamp 51. Lamp 51 now has 5 volts of the 6 volts of power supply 48 applied to its terminals. Lamp 51 now operating at its full design voltage emits a bright light. This circuit is a standard voltage control circuit and the parameters used are typical. The idea of reversing the batteries to employ this circuit to dim the flashlight is unique.

Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept.

It is to be understood, therefore, that within the scope of the appended claims, the invention may be practiced otherwise than as specifically set forth herein.

What is claimed is:

1. A flashlight including:

a light module incorporating a lamp, said light module including a first terminal and a second terminal;

a power supply defining an elongated power supply contour, said elongated power supply contour having a centroid, said power supply further including a positive terminal and a negative terminal;

energizing means to apply said power supply to said lamp;

a bezel element;

a light cover;

a case comprising a hollow elongated battery section and a hollow head section, said elongated battery section including a first end and a second end, said hollow elongated battery section closed at said first end and integrally connected to said hollow head section at said second end, said hollow head section accepting said light module through a head opening, said elongated battery section and said hollow head section configured whereby said power supply is accepted by said elongated battery section and said elongated power supply contour is substantially visible through said head opening;

said positive terminal located within said elongated power supply contour and said negative terminal located within said elongated power supply contour;

said case comprising means to align said power supply and said light module to effect a first electrical connection between said first terminal and said positive terminal and to effect a second electrical connection between said second terminal and said negative terminal;

a first spring at said first end or said second end of said elongated battery section which upon being deflected creates a force to enhance said first electrical connection; and, a second spring at said first end or said second end of said elongated battery section which upon being deflected creates a force to enhance said second electrical connection.

2. A flashlight including:

a light module incorporating a lamp, said light module including a first terminal and a second terminal;

a power supply defining an elongated power supply contour, said elongated power supply contour having a centroid, said power supply further including a positive terminal and a negative terminal;

energizing means to apply said power supply to said lamp;

a bezel element;

a light cover;

a case comprising a hollow elongated battery section and a hollow head section, said elongated battery section including a first end and a second end, said hollow elongated battery section closed at said first end and integrally connected to said hollow head section at said second end, said hollow head section accepting said light module through a head opening, said elongated battery section and said hollow head section configured whereby said power supply is accepted by said elongated battery section and said elongated power supply contour is substantially visible through said head opening;

said hollow head section having a head cavity, said head cavity having a centroidal axis; and, said centroid of said elongated power supply contour located substantially along said centroidal axis of said head cavity.

3. A flashlight including:

a light module incorporating a lamp, said light module further including a first terminal and a second terminal;

a power supply defining an elongated power supply contour, said elongated power supply contour having a centroid, said power supply including a positive terminal and a negative terminal;

energizing means to apply said power supply to said lamp;

a bezel element;

a light cover;

a case comprising a hollow elongated battery section and a hollow head section, said elongated battery section including a first end and a second end, said hollow elongated battery section closed at said first end and integrally connected to said hollow head section at said second end, said hollow head section accepting said light module through a head opening, said elongated battery section and said hollow head section configured whereby said power supply is accepted by said elongated battery section and said elongated power supply contour is substantially visible through said head opening; and, a switch to control the application of said power supply to said lamp, said switch activated by contact with said case.

4. A flashlight according to any of claims 1, 2 or 3 which additionally comprises;

said hollow head section further including a fastening means to attach said bezel element and said light cover to said case to thereby close said head opening;

said fastening means including a head thread section in said hollow head section and a mating bezel thread at said bezel element to facilitate the fastening of said bezel element to said case;

said head thread section at least partially located within a reference circle, said reference circle centered about said centroid of said elongated power supply contour and including a diameter equal to the largest linear dimension of said elongated power supply contour.

5. A flashlight according to any of claims 1, 2 or 3 which additionally comprises;

said hollow head section further including a fastening means to attach said bezel element and said light cover to said case to thereby close said head opening;

said fastening means including a head thread section within said hollow head section and a mating bezel thread at said bezel element to facilitate the fastening of said bezel element to said case;

said head thread section at least partially located within a reference circle, said reference circle centered about said centroid of said elongated power supply contour and including a diameter equal to the largest linear dimension of said elongated power supply contour.

said hollow head section including an interior wall; and, said bezel element supporting an O-ring which forms a watertight seal against said interior wall.

6. A flashlight according to any of claims 1, 2 or 3 which additionally comprises;

said hollow head section further including a fastening means to attach said bezel element and said light cover to said case to thereby close said head opening; and, said fastening means including a head locking element within said hollow head section and a bezel locking element at said bezel element wherein upon rotation of said bezel element about said hollow head section said bezel locking element mates with said head locking element to facilitate the fastening of said bezel element to said case;

said head locking element at least partially located within a reference circle, said reference circle centered about said centroid of said elongated power supply contour and including a diameter equal to the largest linear dimension of said elongated power supply contour.

7. A flashlight according to any of claims 1, 2 or 3 which additionally comprises;

said hollow head section further including a fastening means to attach said bezel element and said light cover to said case to thereby close said head opening;

said fastening means including a head locking element within said hollow head section and a bezel locking element at said bezel element wherein upon rotation of said bezel element about said hollow head section said bezel locking element mates with said head locking element to facilitate the fastening of said bezel element to said case;

said hollow head section including an interior wall and said head locking element comprising an inwardly projecting ledge on said interior wall;

said bezel locking element comprising an outwardly extending pin on said bezel; and, said head locking element at least partially located within a reference circle, said reference circle centered about said centroid of said elongated power supply contour and including a diameter equal to the largest linear dimension of said elongated power supply contour.

8. A flashlight according to any of claims 1, 2 or 3 which additionally comprises;

said hollow head section further including a fastening means to attach said bezel element and said light cover to said case to thereby close said head opening;

said fastening means including a head locking element within said hollow head section and a mating bezel locking element at said bezel element to facilitate the fastening of said bezel element to said case;

said hollow head section further including an interior wall;

said bezel element further supporting an O-ring forming a watertight seal against said interior wall;

said head locking element at least partially located within a reference circle, said reference circle centered about said centroid of said elongated power supply contour and including a diameter equal to the largest linear dimension of said elongated power supply contour.

9. A flashlight according to any of claims 1, 2 or 3 which additionally comprises;

said hollow head section further including a fastening means to attach said bezel element and said light cover to said case to thereby close said head opening;

said fastening means including a head locking element within said hollow head section and a bezel locking element at said bezel element wherein upon rotation of said bezel element about said hollow head section said bezel locking element mates with said head locking element to facilitate the fastening of said bezel element to said case;

said hollow head section including an interior wall and said head locking element comprising an inwardly projecting pin on said interior wall;

said bezel locking element comprising a ledge on said bezel element;

said head locking element at least partially located within a reference circle, said reference circle centered about said centroid of said elongated power supply contour and including a diameter equal to the largest linear dimension of said elongated power supply contour.

10. A flashlight according to any of claims 1, 2 or 3 wherein;

said head opening is a circle;

said elongated power supply contour includes two adjacent circles; and, the centroid of said head opening is located substantially along the centroidal axis of said power supply which passes through said centroid of said elongated power supply contour.

11. A flashlight according to any of claims 1, 2 or 3 wherein;

said power supply includes two round cylindrical batteries; and, said elongated power supply contour is two adjacent circles.

12. A flashlight according to any of claims 1, 2 or 3 wherein;

said flashlight further includes an electric circuit whereby upon connection of said power supply positive terminal to said light module first terminal and connection of said power supply negative terminal to said light module second terminal said lamp emits light of a first intensity;

upon connection of said power supply positive terminal to said light module second terminal and connection of said power supply negative terminal to said light module first terminal said lamp emits light of a second intensity; and, said first intensity is different from said second intensity.

13. A flashlight according to any of claims 1, 2 or 3 wherein;

upon connection of said power supply positive terminal to said light module first terminal and connection of said power supply negative terminal to said light module second terminal said lamp emits light of a first color;

upon connection of said power supply positive terminal to said light module second terminal and connection of said power supply negative terminal to said light module first terminal said lamp emits light of a second color; and, said first color is different from said second color.

14. A flashlight according to any of claims 1, 2 or 3 wherein;

said positive terminal is located within said elongated power supply contour; and, said negative terminal is located within said elongated power supply contour.

15. A flashlight according to any of claims 1 or 2 which further includes:

a switch to control the application of said power supply to said lamp, said switch activated by contact with said case.

16. A flashlight according to any of claims 1 or 2 which further includes:

a switch located on said light module to control the application of said power supply to said lamp.

17. A flashlight according to any of claims 1 or 2 which further includes:

a switch located on said light module to control the application of said power supply to said lamp, said switch activated by contact with said case; and, a spring which upon being deflected creates a spring force which deters contact between said switch and said case.

18. A flashlight according to any of claims 1 or 2 which further includes:

a switch located on said light module to control the application of said power supply to said lamp, said switch activated by contact with said case;

a spring which upon being deflected creates a spring force which deters contact between said switch and said case;

activation means to overcome said spring force to compel contact between said switch and said case.

19. A flashlight according to any of claims 1 or 2 which further includes:

a switch located on said light module to control the application of said power supply to said lamp, said switch activated by contact with said case;

a spring which upon being deflected creates a spring force which deters contact between said switch and said case;

activation means to overcome said spring force to compel contact between said switch and said case; and, said activation means including moving said bezel into said hollow head section.

20. A flashlight according to claim 1 wherein;

said means to align said power supply and said light module includes restricting the movement of an offset element to prevent rotation of said light module.

21. A flashlight according to claim 3 which further comprises;

said switch located on said light module.

22. A flashlight according to claim 3 which further comprises;

said switch located on said light module; and, a base spring at said first end of said elongated battery section which upon being deflected creates a spring force which deters contact between said switch and said case.

23. A flashlight according to claim 3 which further comprises;

said switch located on said light module; and, a base spring at said first end of said elongated battery section which upon being deflected creates a spring force which deters contact between said switch and said case.

24. A flashlight according to claim 3 which further comprises;

said switch located on said light module;

a base spring at said first end of said elongated battery section which upon being deflected creates a spring force which deters contact between said switch and said case; and, activation means to overcome said spring forces to compel contact between said switch and said case.

25. A flashlight according to claim 3 which further comprises;

said switch located on said light module;

a base spring at said first end of said elongated battery section which upon being deflected creates a spring force which deters contact between said switch and said case;

activation means to overcome said spring force to compel contact between said switch and said case; and said activation means including moving said bezel about said hollow head section.

26. A flashlight according to claim 3 which further comprises;

said switch is activated by contact with a portion of said case which is substantially perpendicular to said elongated battery section.

27. A flashlight including:

a light module incorporating a lamp;

a power supply including a positive terminal and a negative terminal;

a bezel element;

a light cover;

a case comprising a hollow elongated battery section and a hollow head section, said elongated battery section including a first end and a second end, said hollow elongated battery section closed at said first end and integrally connected to said hollow head section at said second end, said elongated battery section configured whereby said power supply is accepted by said elongated battery section;

a switch to connect said power supply to said lamp, said switch activated by contact with said case;

a spring which upon being deflected creates a spring force which deters said switch from connecting said power supply to said lamp;

activation means to overcome said spring force to compel said switch to connect said power supply to said lamp.

28. A flashlight including:

a light module incorporating a lamp;

a power supply including a positive terminal and a negative terminal;

energizing means to apply said power supply to said lamp;

a bezel element;

a light cover;

a case comprising a hollow elongated battery section and a hollow head section, said elongated battery section including a first end and a second end, said hollow elongated battery section closed at said first end and integrally connected to said hollow head section at said second end, said elongated battery section configured whereby said power supply is accepted by said elongated battery section; and, a switch to connect said power supply to said lamp, said switch activated by contact with said case;

said switch located on said light module;

a spring which upon being deflected creates a spring force which deters said switch from connecting said power supply to said lamp;

activation means to overcome said spring force to compel said switch to connect said power supply to said lamp; and, said activation means including moving said bezel into said hollow head section.

29. A flashlight according to any of claims 27 or 28 which further comprises;

said light module further including a first terminal and a second terminal; and, means to effect an electrical connection between said first terminal and said power supply positive terminal such that said electrical connection is enhanced by said spring force.

30. A flashlight according to any of claims 27 or 28 wherein;

said switch is activated by contact with a portion of said case which is substantially perpendicular to said elongated battery section.

* * * * *